United States Patent [19]

Lawson et al.

[11] 4,085,547

[45] Apr. 25, 1978

[54] SKATE SHARPENER

[75] Inventors: John B. Lawson, Central Falls, R.I.; Charles Simpson Cooper, Attleboro, Mass.; Alfred Slocum Vail, Barrington, R.I.

[73] Assignee: Lawson-Hemphill Inc., Central Falls, R.I.

[21] Appl. No.: 792,910

[22] Filed: May 2, 1977

[51] Int. Cl.[2] ..... B24B 7/02

[52] U.S. Cl. ..... 51/47; 51/99; 51/228

[58] Field of Search ..... 51/34 C, 35, 37, 47, 51/99, 228

[56] References Cited

U.S. PATENT DOCUMENTS

| | | | |
|---|---|---|---|
| 2,982,056 | 5/1961 | Edqvist | 51/99 X |
| 3,036,409 | 5/1962 | Whitcomb | 51/99 |
| 3,053,018 | 9/1962 | Tracy | 51/99 X |

*Primary Examiner*—Gary L. Smith

[57] ABSTRACT

A skate sharpener having a grinding wheel supported over the skate by a combined parallelogram and Watts linkage which guides the grinding element substantially parallel with the sharpened surface of the skate blade while keeping the grinding pressure constant; in preferred embodiments a tension spring forms one vertical link of the parallelogram linkage and a hydraulic cylinder, connected between the parallelogram linkage and the sharpener base, provides a smooth sharpening speed.

7 Claims, 1 Drawing Figure

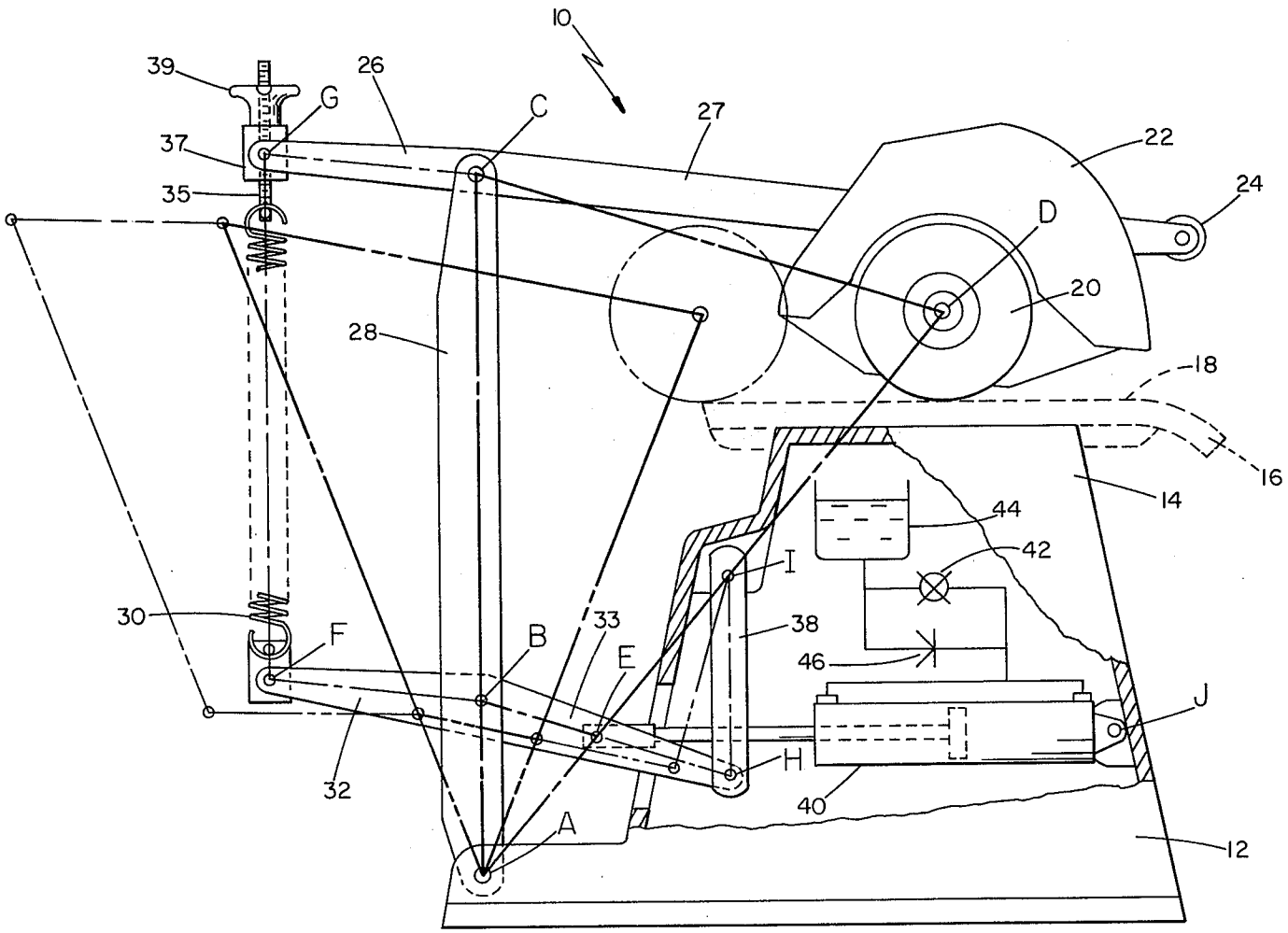
10
12
14
16
18
20
22
24
26
27
28
30
32
33
35
37
38
39
40
42
44
46
A
B
C
D
E
F
G
H
I
J

SKATE SHARPENER

FIELD OF THE INVENTION

This invention relates to sharpeners for ice skates.

BACKGROUND OF THE INVENTION

A well sharpened skate blade must be uniformly ground along its entire sharpened length. This is conventionally achieved by moving the skate along a grinding wheel and depending on a skilled operator to uniformly apply grinding pressure while maintaining a steady relative speed between the grinding wheel and blade. Uniformity in both pressure and speed is necessary to avoid excess grinding at points along the blade.

Two types of sharpeners are predominant in the field. Most popular is the table-top machine in which a horizontally-clamped skate, floated on arms or slid across the table in a fixture, is manually pushed back and forth against a stationary, horizontal grinding wheel. Grinding pressure is entirely a function of operator-applied forces. Less familiar is the vertical-clamp sharpener in which a vertical grinding wheel, supported by a linkage and spring, is manually drawn over an inverted, vertically-clamped skate. Grinding pressure depends on the fraction of the grinding wheel weight not supported by the linkage and spring. But (absent operator correction) conventional vertical-clamp sharpeners produce substantial variations in grinding pressure at the blade extremities, and some (particularly those with overhead springs as support for the grinding wheel) vary sharpening speed at the blade extremities due to horizontal forces imparted by the spring. Further, neither the table-top nor the vertical-clamp sharpener presently employ any means to assist the operator in achieving uniformity in sharpening speed. All of which leads, without the careful attention of a skilled operator, to poor sharpening quality.

SUMMARY OF THE INVENTION

We have discovered that nearly uniform grinding pressure may be achieved independent of operator skill in the vertical-clamp sharpener by providing as support for the grinding wheel a parallelogram linkage which keeps the grinding wheel substantially parallel with the sharpened surface of the skate blade while keeping the grinding pressure nearly constant. One arm of the linkage supports the grinding wheel, and a second arm, parallel the supporting arm, has a control axis whose location bears a geometric similarity with the grinding wheel axis. Two similar triangles, having two common sides, are formed by the linkage, and the control and grinding wheel axes are situated at similar corners of the two triangles. A second mechanism prescribes for the control axis a path substantially parallel the sharpened surface of the skate blade, and, due to the geometric similarity between the two axes, the parallel motion is transferred to the grinding wheel. In preferred embodiments a Watts linkage serves to keep the control axis in a horizontal plane, and a tension spring, forming one vertical arm of the parallelogram linkage, partially supports the grinding wheel load. All this is achieved in a very compact structure.

Further discovered is that uniform sharpening speed can be achieved in a skate sharpener by providing, connected between the supporting linkage and the sharpener base, a hydraulic cylinder which forces hydraulic fluid through an adjustable orifice during the skate-sharpening stroke and, in preferred embodiments, allows for unimpeded fluid return flow through a check valve on the return stroke. With the invention an operator need only learn to apply a steady force to achieve uniform speed, a much easier task than learning to directly control speed.

PREFERRED EMBODIMENT

We turn now to description of a presently preferred embodiment of the invention.

DRAWINGS

FIG. 1 is a front elevation, somewhat diagrammatic and schematic, of said embodiment.

DESCRIPTION

The embodiment shown in the drawing and its operation are now described.

1. Embodiment

Shown in FIG. 1 is a vertical-clamp sharpener, indicated generally at 10.

It includes a base 12 with an integral pedestal 14 to which a skate 16 is clamped in inverse position by a simple vise system not shown. This exposes the skate blade 18 to grinding wheel 20 which is driven by integrally-mounted motor 22, both of which rotate about grinding wheel axis D. A linkage system, including a spring, supports the grinding wheel assembly, allowing an operator using handle 24 to draw the wheel back and forth across blade 18, as well as raise and lower it.

Four arms, forming a parallelogram, make up the supporting linkage system; support arm 26, control arm 32, vertical arm 28, and a fourth arm formed by tension spring 30. Pivotally interconnected at axes G, C, B and F, they form a parallelogram linkage which maintains support arm 26 parallel with control arm 32. Extension 27 on the support arm carries the grinding wheel assembly, and the entire linkage is pivotally supported from the sharpener base at pivot axis A at the base of vertical arm 28. Axes A, B and C, along the vertical arm, are coplanar. Adjustment in the tension spring preload, necessary to adjust the grinding pressure on the skate, is made by turning adjustment knob 39 which is threadedly connected to hook 35 whose other end grasps spring 30. Block 37, through which hook 35 centrally passes, makes the pivotal connection at axis G with the support arm.

Working in conjunction with the parallelogram linkage to keep the grinding wheel axis parallel with the sharpened surface of the skate blade, is a familiar, three-link Watts linkage. Leg AB of vertical arm 28 and vertical link 38, pivoted from the sharpener base at axis I, form the two equal-length, rotating links of the linkage. Extension 33 of control arm 32, pivotally connected to the two rotating links at axes B and H, forms the connecting link. Located at a point midway between axes B and H, and thereby kept in a horixontal plane by the well-known arc-cancelling effect of the Watts linkage, is control axis E.

By further locating axis E, now with respect to the grinding wheel axis, the horizontal motion prescribed by the Watts linkage can be transferred to the grinding wheel. Control axis E is located so as to be coplanar with pivot axis A and grinding wheel axis D, and so as to define with pivot axis B a plane parallel the plane defined by axis D and pivot axis C. The result is a pair of similar triangles, ABE and ACD, which have two common sides, and which retain their relationship for any position taken by the parallelogram linkage, thus requiring axis D to describe a plane parallel that described by axis E. The unchanging relationship of the two triangles results because legs AB and AC, both physically part of vertical arm 28, remain common while legs BE and CD, both physically elements of opposite arms of the parallelogram linkage, remain parallel. A graphical demonstration of the result is shown in FIG. 1 by the superposition of linkage centerlines corresponding to a second grinding wheel position.

Although not shown in the FIGURE, the grinding wheel axis does, for the same grinding pressure, dip slightly below the horizontal at the blade extremities, due to elongation of spring 30 in its off-vertical position. The elongation is needed to maintain a force balance. The effective force imparted to the support arm by the spring is reduced by the Cosine of the angle from the vertical, and the small elongation of the spring compensates for the reduced effectiveness. It should be understood, of course, that if the skate blade surface is perfectly horizontal, then the grinding wheel, which rides on the blade surface, will remain horizontal and no spring elongation will result. Instead, the reduced effective spring force will result in increased grinding pressure on the skate blade. Fortunately, however, it is possible to take advantage of this seeming disadvantage and tailor the appropriate design parameters to produce a grinding wheel dip which more closely matches the rounded contour of the average skate blade than does a perfectly horizontal path. Those parameters which affect grinding wheel dip and which must be tailored are the spring stiffness, the proportions of support arm 26, which acts as a lever, and the spring angle from the vertical at maximum excursion (keeping this angle less than 15° will keep the increase in grinding pressure below 3 percent).

In addition to uniform grinding pressure, uniform sharpening speed is desirable to prevent excess grinding at points along the blade. Improved uniformity in speed is achieved by installing hydraulic cylinder 40 between the supporting linkage and the sharpener base; the cylinder is installed horizontally with rotatable connections at control axis E and axis J on the sharpener base. During cylinder compression, fluid (ordinary incompressible hydraulic fluid) not absorbed by the rod side of the actuator is forced out of the cylinder and through adjustable needle valve 42 into reservoir 44. During cylinder extension, the fluid returns unimpeded through check valve 46. The needle valve restriction on flow provides a steady cylinder velocity and, thus, a steady grinding wheel velocity for a given application of force at handle 24.

2. Operation

With a skate clamped in inverse position, the grinding wheel is lowered onto the blade and the grinding pressure (the load carried by the skate blade) is adjusted using knob 39. Sharpening is accomplished in smooth, constant speed strokes by pulling the grinding wheel across the blade against the restraint of the hydraulic cylinder; the amount of restraint is adjustable using the needle valve. Return strokes of the wheel are unimpeded by the cylinder and the operator will typically raise the grinding wheel on a return stroke.

CONCLUSION

Other embodiments are within the scope of the invention and claims. For example, the Watts linkage could be replaced by a wheel rotatably fastened at control axis E and supported on a flat, horizontal plane. And also, adjustments could be made in the platform contour or Watts linkage so as to deliberately produce at the grinding wheel axis a non-horizontal, or nonplanar, motion which more closely matched a particular skate blade.

We claim:

1. A skate sharpener for sharpening an inverted, vertically-clamped skate by moving a grinding wheel supported over said skate in successive strokes across the skate blade, the improvement comprising:

a parallelogram linkage supporting said grinding wheel, said parallelogram linkage including a vertical arm pivoted at the sharpener base about a base axis, a support arm supporting said grinding wheel for rotation about a grinding wheel axis and pivotally connected to said vertical arm about a third axis, a control arm, said control arm parallel with said support arm and pivotally connected about a fourth axis to said vertical arm, said fourth axis coplanar with said third axis and said base axis, said control arm having a control axis coplanar with said base axis and said grinding wheel axis, said control axis defining with said fourth axis a plane parallel with the plane defined by said grinding wheel axis and said third axis; and means defining with said vertical arm, said support arm, and said control arm a fourth member of said parallelogram linkage;

said fourth member comprising spring means to partially support the grinding wheel load; and control means to keep said control axis substantially parallel with the sharpened surface of the skate blade, thereby also keeping said grinding wheel axis substantially parallel with the sharpened surface of the skate blade.

2. The skate sharpener of claim 1 in which said spring means is a tension spring and is said fourth member of said parallelogram linkage.

3. The skate sharpener of claim 1 in which said control means is a Watts linkage.

4. The skate sharpener of claim 2 in which the load in said tension spring is adjusted by adjusting the extended length of said tension spring.

5. The skate sharpener of claim 1 further comprising means to control the translation speed of said control axis, thereby controlling the translation speed of said grinding wheel during sharpening.

6. The skate sharpener of claim 5 in which said means to control the translation speed of said control axis is a hydraulic cylinder connected between said control axis and the sharpener base, and an orifice through which hydraulic fluid is forced by motion of said hydraulic cylinder during the sharpening stroke of said grinding wheel.

7. The skate sharpener of claim 6 in which the hydraulic fluid is allowed to flow unimpeded through a check valve on the return stroke of said grinding wheel.

* * * * *